US012643025B2

(12) United States Patent
Stucker et al.

(10) Patent No.: US 12,643,025 B2
(45) Date of Patent: Jun. 2, 2026

(54) PORTABLE BASKETBALL GAME WITH DUNK MODE

(71) Applicant: Pop-A-Shot Enterprise LLC, Peoria, IL (US)

(72) Inventors: Anthony John Stucker, Peoria, IL (US); Ben Pollard, Peoria, IL (US)

(73) Assignee: Pop-A-Shot Enterprise LLC, Peoria, IL (US)

( * ) Notice: Subject to any disclaimer, the term of this patent is extended or adjusted under 35 U.S.C. 154(b) by 403 days.

(21) Appl. No.: 18/500,342

(22) Filed: Nov. 2, 2023

(65) Prior Publication Data

US 2025/0144493 A1 May 8, 2025

(51) Int. Cl.
*A63B 63/08* (2006.01)
*A63B 71/06* (2006.01)

(52) U.S. Cl.
CPC ..... *A63B 63/083* (2013.01); *A63B 71/0605* (2013.01); *A63B 71/0622* (2013.01); *A63B 71/0669* (2013.01); *A63B 2063/086* (2013.01); *A63B 2071/0625* (2013.01); *A63B 2210/50* (2013.01)

(58) Field of Classification Search
CPC . A63B 63/083; A63B 63/08; A63B 2063/086; A63B 71/0605; A63B 71/0622; A63B 71/0669; A63B 2071/0625
See application file for complete search history.

(56) References Cited

U.S. PATENT DOCUMENTS 4,424,968 A * 1/1984 Smith ..... A63B 63/083 473/481
5,039,977 A * 8/1991 Mele ..... A63B 71/06 273/371
5,066,006 A * 11/1991 Driska ..... A63B 63/083 473/483
5,224,699 A * 7/1993 Zaruba ..... A63B 63/083 273/375
5,300,920 A * 4/1994 Caselli ..... A63B 63/083 473/480
5,318,289 A * 6/1994 Mahoney ..... A63B 63/083 473/486
6,389,368 B1 * 5/2002 Hampton ..... A63B 71/0669 473/480

(Continued)

*Primary Examiner* — Nicholas J. Weiss
(74) *Attorney, Agent, or Firm* — Endurance Law Group PLC; James R. Yee

(57) ABSTRACT

A basketball game includes a controller, first and second sensors, an audio device, a mounting bracket, a backboard mounted to the mounting bracket, and a basketball rim. The first sensor is configured to detect a basketball traveling though the basketball rim and to responsively generate a first signal. The second sensor is configured to detect movement of the basketball rim from a first position to a second position and responsively generating a second signal. The controller is configured to: initiating a game, detecting receipt of the first signal, detecting receipt of the second signal, playing a first audio signal through the audio device if the first signal was detected and the second signal was not detected within a predetermined time period, and, playing a second audio signal through the audio device if the first signal was detected and the second signal was detected within a predetermined time period.

19 Claims, 13 Drawing Sheets

(56) References Cited

U.S. PATENT DOCUMENTS

| | | | | |
|---|---|---|---|---|
| 7,214,148 | B2 * | 5/2007 | Mahoney | A63B 63/083 473/486 |
| 7,899,307 | B1 * | 3/2011 | Hughes | A63B 71/0605 386/343 |
| 9,511,278 | B2 * | 12/2016 | Lee | A63F 7/0664 |
| 11,484,760 | B2 * | 11/2022 | Anton | A63B 71/0605 |
| 11,701,567 | B2 * | 7/2023 | Tsai | A63B 63/083 473/480 |
| 12,115,428 | B1 * | 10/2024 | Anton | A63B 69/0071 |
| 2008/0254866 | A1 * | 10/2008 | Young | A63B 71/0622 463/25 |
| 2016/0193518 | A1 * | 7/2016 | Baxter | A63B 21/0442 473/483 |
| 2018/0200595 | A1 * | 7/2018 | Givens | A63B 63/083 |
| 2020/0086194 | A1 * | 3/2020 | Gordon | A63B 24/0062 |
| 2023/0031488 | A1 * | 2/2023 | Gordon | G09B 19/0038 |
| 2024/0399225 | A1 * | 12/2024 | Chen | A63B 71/0622 |
| 2024/0408474 | A1 * | 12/2024 | Costabile | A63B 71/0669 |
| 2025/0177839 | A1 * | 6/2025 | Chandan | A63B 71/0622 |

* cited by examiner

PORTABLE BASKETBALL GAME WITH DUNK MODE

BACKGROUND OF THE INVENTION

Field of the Invention

The invention relates generally to portable sport games, and more particularly to a portable basketball game with a dunk sensor.

BACKGROUND OF THE INVENTION

Home or portable basketball games that may be removably mounted to a door allow a player to shoot compete against themselves or two or more players to compete against each other in basketball shooting games are very popular. Typically, such games may include a basketball rim and the net fixedly mounted to a basketball backboard. The players shoot a basketball towards the basketball net and mentally keep score of "baskets", i.e., when the basketball falls through the basketball net.

In other versions of the game, the basketball game may include a controller and a sensor which detects basket. The controller may count such baskets, i.e., maintain and increment a counter during a game or instance of the game. Additionally, the basketball game may include a speaker or other audio device that plays when a made basket is detected by the sensor.

It is desirable to add excitement to the games played on the portable basketball game.

BRIEF SUMMARY OF THE INVENTION

In one aspect of the present invention a basketball game is provided. The basketball game includes a mounting bracket, a backboard mounted to the mounting bracket, and a basketball rim rotatably coupled to the backboard and being movable between a first position and a second position. The basketball game further includes a controller, first and second sensors, and an audio device. The first sensor is configured to detect a basketball traveling though the basketball rim and to responsively generate a first signal. The second sensor is configured to detect movement of the basketball rim from the first position to the second position and responsively generating a second signal. The controller is configured to receive the first and second signals to perform the steps of initiating an instance of a game, detecting receipt of the first signal, detecting receipt of the second signal, playing a first audio signal through the audio device if the first signal was detected and the second signal was not detected within a predetermined time period, and playing a second audio signal through the audio device if the first signal was detected and the second signal was detected within a predetermined time period.

In a second aspect of the present invention, a basketball game is provided. The basketball game includes a mounting bracket, a backboard mounted to the mounting bracket, and a basketball rim rotatably coupled to the backboard and being movable between a first position and a second position. The basketball game further includes a first sensor, a second sensors, a display device, an audio device and a controller. The first sensor is configured to detect a basketball traveling though the basketball rim and to responsively generate a first signal. The second sensor is configured to detect movement of the basketball rim from the first position to the second position and to responsively generate a second signal. The controller is mounted to the backboard. The first and second sensors, the display, and the audio device being electrically coupled to the controller. The controller is configured to receive the first and second signals and to perform the steps of:

(1) initiating an instance of a game,
(2) detecting receipt of the first signal,
(3) detecting receipt of the second signal,
(4) playing a first audio signal through the audio device if the first signal was detected and the second signal was not detected within a predetermined time period,
(5) playing a second audio signal through the audio device if the first signal was detected and the second signal was detected within a predetermined time period,
(6) maintaining a counter indicative of a number of points made during the game, and
(7) displaying the counter on the display.

In a third aspect of the present invention, a basketball game is provided. The basketball game includes a a mounting bracket including a pair of hooks configured to mount over a door, a backboard mounted to the mounting bracket, a basketball rim mounting bracket connected to the basketball backboard, and a basketball rim rotatably coupled to the basketball rim mounting bracket and being movable between a first position and a second position. The basketball game further includes a first sensor configured to detect a basketball traveling though the basketball rim and to responsively generate a first signal, a second sensor configured to detect movement of the basketball rim from the first position to the second position and responsively to responsively generate a second signal. a display device, an audio device, and a controller mounted to the backboard. The first and second sensors, the display, and the audio device are electrically coupled to the controller. The controller includes an on/off switch and is configured to receive the first and second signals. The controller performing the steps of:

(1) initiating an instance of a game in response to the switch being moved from an off position to an on position, the instance of the game,
(2) detecting receipt of the first signal,
(3) detecting receipt of the second signal,
(4) playing a first audio signal through the audio device if the first signal was detected and the second signal was not detected within a predetermined time period,
(5) playing a second audio signal through the audio device if the first signal was detected and the second signal was detected within a predetermined time period,
(6) maintaining a counter indicative of a number of points made in the game during the predetermined time period, and
(7) displaying the counter on the display.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Figure 1:
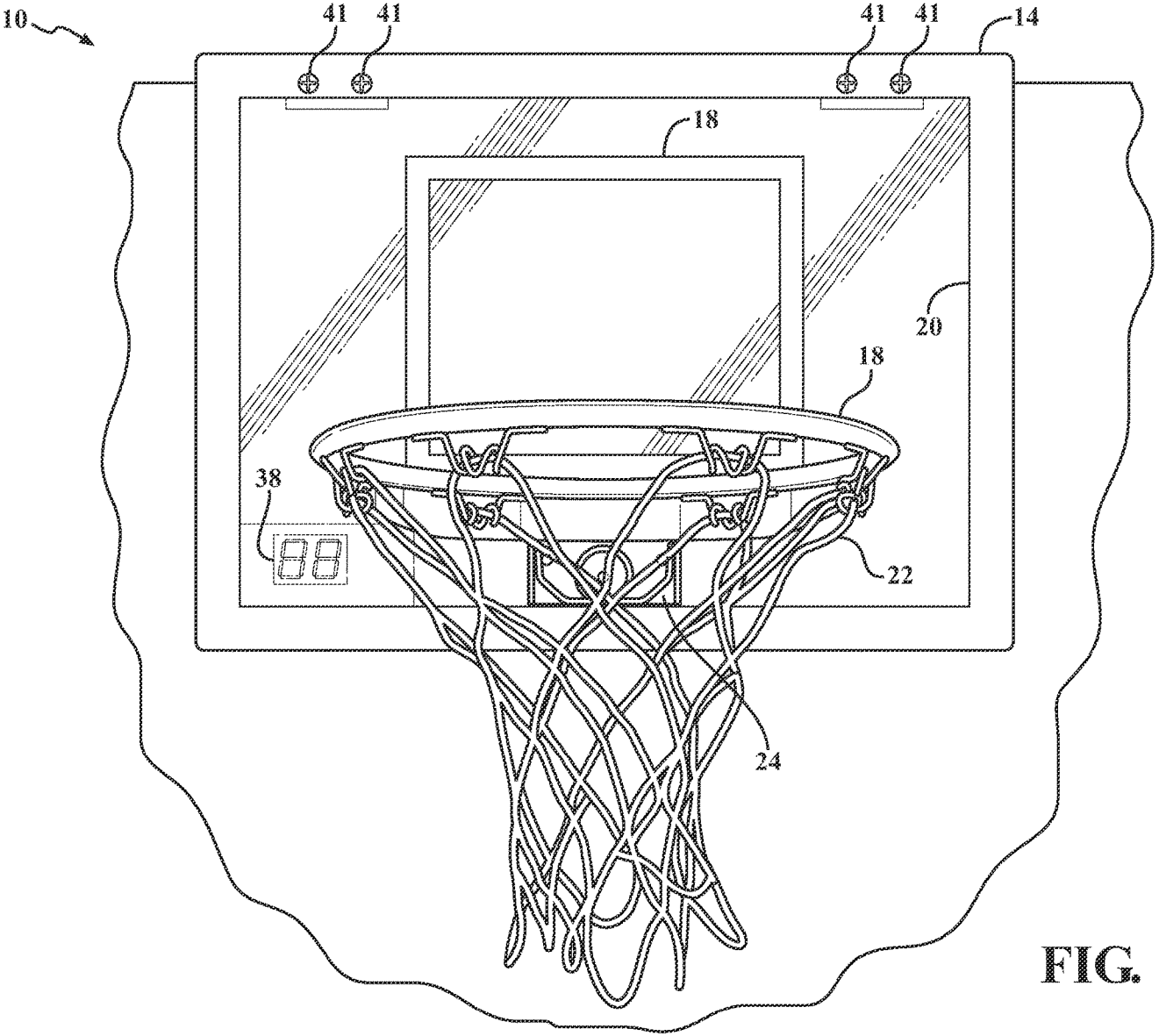
FIG. 1 is a front view of a portable basketball game, according to an embodiment of the present invention.

With reference to the drawings, and in operation, the present invention provides a basketball game 10 to player(s). In the illustrated embodiment, the basketball game 10 includes a backboard 14 and a mounting bracket 12. The backboard 14 is generally made from a rigid material which may be transparent, e.g., tempered glass or Plexiglas, or opaque, such as a plastic, fiberglass, a composite material, or any suitable material. In one aspect of the present invention, the basketball game 10 is a miniature or portable game configured to be player or used indoors and temporarily mounted to a door door. However, the present invention may also be used with a larger or standard-sized basketball game and be mounted to a frame or pole (not shown). A standard-sized or regulation backboard is generally rectangular and has a width of 6 feet (1.83 m) and a height of 3.5 feet (1.07 m). The backboard 14 of a portable basketball game 10 may have dimensions with the same or similar ratios. As discussed in more detail below, the basketball game 10 further includes a basketball rim 16 rotatably coupled to the backboard 14 and being movable between a first position and a second position (see below). A basketball net 22 may be attached to the basketball rim 16.

In one embodiment, the mounting bracket 12 includes a pair of hooks 40 configured to be hooked over a door (not shown). As shown, the hooks 40 may be mounted to the backboard 14 by a plurality of fasteners 41. A plurality of foam attachments 56 may be affixed to the back of the backboard 14 to protect the door or other surface. Alternatively, the mounting bracket 12 may be configured to be mounted to a pole or frame (not shown).

In general, the basketball game 10 of the present invention, provides or plays an audio signal in celebration of a basket or shot being made, i.e., "celebration" audio signal. Generally, a shot is made when a basketball goes through the basketball rim 16 and the basketball net 22. A "normal" shot occurs when a player shoots the basketball and the basketball leaves the player's hand(s) before reaching the basketball rim 16. A dunk shot or "dunk" is a shot that is made (or attempted) when a player jumps in the air and pushes the basketball ball down through the basketball rim and net 16, 22 (while making contact with, and moving, the rim 16 downward).

With specific reference to FIGS. 1-12, the backboard 14 may have an inner diameter indicia 18 and an outer diameter indicia 20. The inner and outer diameter indicia 18, 20 may be comprised of paint, stickers or the like. The inner and outer diameter indicia 18, 20 provide visual cues or targets to the player(s) while attempting to put a basketball through the basketball rim 16.

Returning to the FIGS, the basketball game 10 may further include a first sensor 24, a second sensor 26, an audio device 26 and a controller 30. The first sensor 24 is configured to detect a basketball (not shown) traveling though the basketball rim 16 and to responsively generate a first signal. The second sensor 26 is configured to detect movement of the basketball rim 16 from the first position to the second position and to responsively generate a second signal.

In one embodiment, the first sensor 26 is an least one infrared (IR) sensor positioned relative, or mounted, to the backboard 14. The first sensor 26 may be mounted through an aperture (not shown) in the backboard 14 located behind the basketball net 22.

In one aspect of the present invention, the basketball rim 14 is mounted to the backboard 14 via a basketball rim mounting bracket 32. The basketball rim mounting bracket 32 is connected to the basketball backboard 14. The basketball rim 14 is rotatably coupled to the basketball rim mounting bracket 14.

In the illustrated embodiment, the basketball rim 16 is a breakaway rim. The basketball rim 16 is moveably between three positions: a first position (see FIGS. 3 and 9), a second position (see FIG. 10). and a third position (see FIGS. 6 and 11). The first, second, and third positions are provided via the basketball rim mounting bracket 32.

In one embodiment, the mounting bracket 12, basketball rim 16, basketball rim mounting bracket 32 may be at least partially composed from steel with a powder coat finish or painted to protect from rust and chipping.

In the first position, the basketball rim 16 is an extended configuration, extending away from the backboard 14. This represents the normal position of the basketball rim 16 during game play. In the illustrated embodiment, the basketball rim 16 extends from the backboard 14 at an angle of approximately 90°, i.e., 90°+/−5°.

Figure 15:
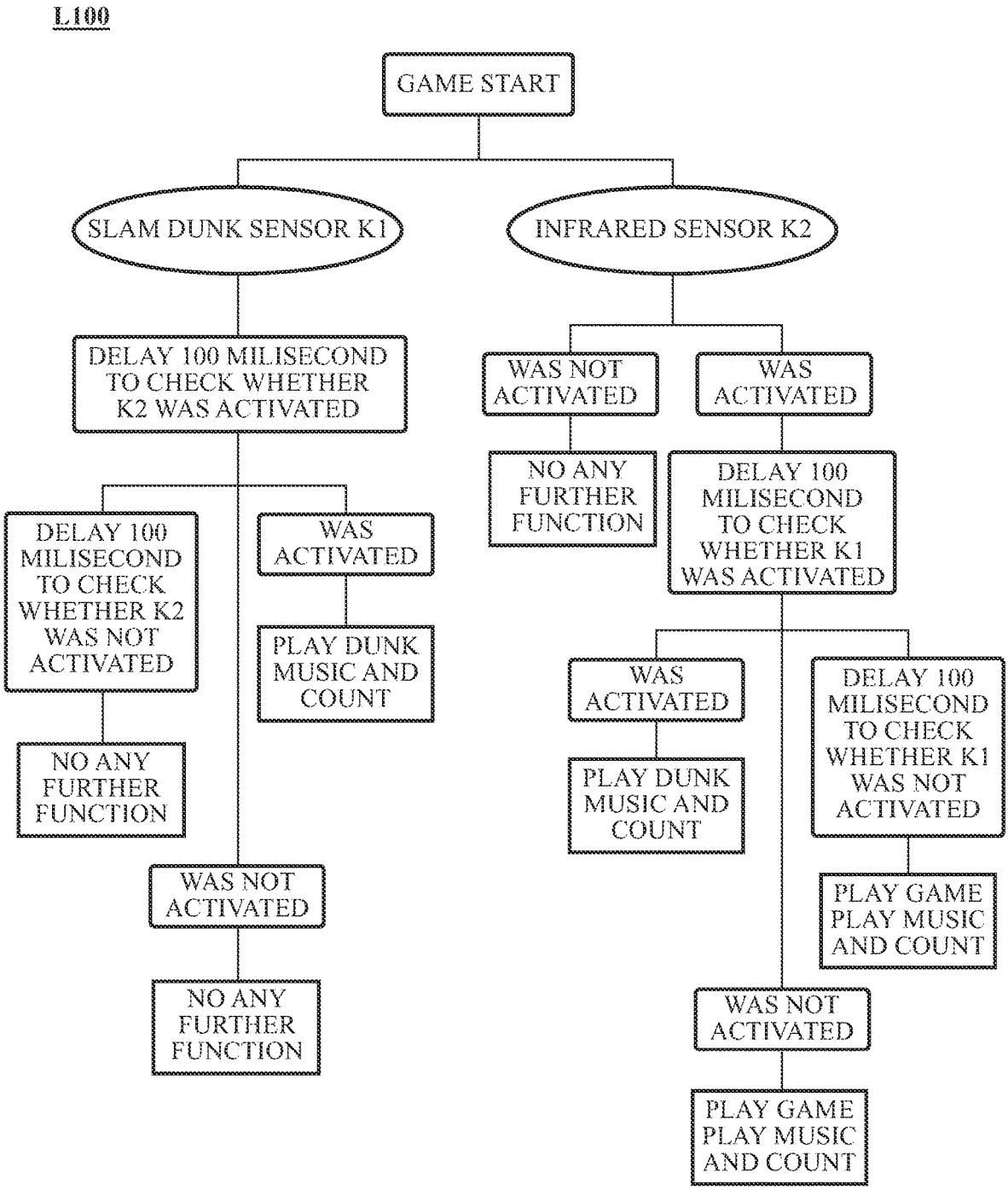
FIG. 15 is a logic diagram associated with the portable basketball game of FIG. 1, according to an embodiment of the present invention.

The third position of the basketball rim 16 corresponds to a storage position, i.e., the basketball rim 16 is rotated upward until the basketball rim 16 is adjacent to, or close to, the backboard 14 (see FIG. 15).

The second position of the basketball rim 16 corresponds to a flexed position in which the basketball rim 16 is rotated or flexed slightly downward in response to a dunk shot being made by the player.

With specific reference to specific reference FIGS. 2-5, in the illustrated embodiment, the basketball rim mounting bracket 32 includes a rear plate 32A and a U-shaped bracket 32B. The rear plate 32A is positioned adjacent a rear surface of the backboard 14 and the U-shaped bracket 32B is positioned adjacent a front surface of the backboard 14. The U-shaped bracket 32B is fastened to the rear plater 32A via a plurality of fasteners 32C, for example, bolts and nuts, inserted through apertures 14A ((see FIG. 4) in the backboard 14.

Figure 2:
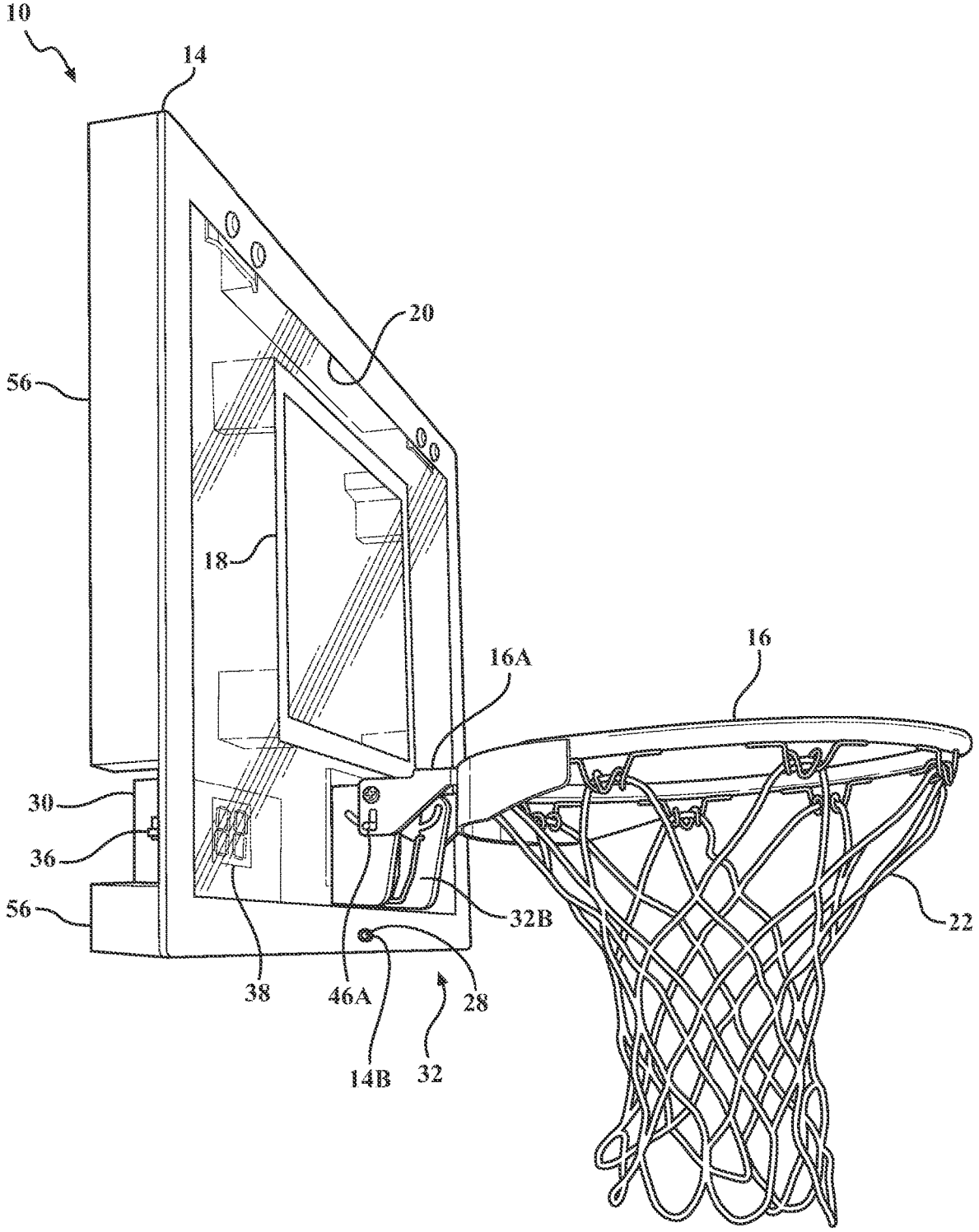
FIG. 2 is a first side view of the portable basketball game of FIG. 1.

As shown in FIG. 2, the basketball rim 16 includes a pair of opposing side panels 16A. Each side panel 16A includes a slot 16B. The basketball rim 16 is rotatably mounted to the U-shaped bracket 32B by a rod 42 positioned and mounted through apertures (not shown) in each side panel 16A of the basketball rim 16 and apertures (not shown) on opposite sides of the U-shaped bracket 32B.

Figure 7:
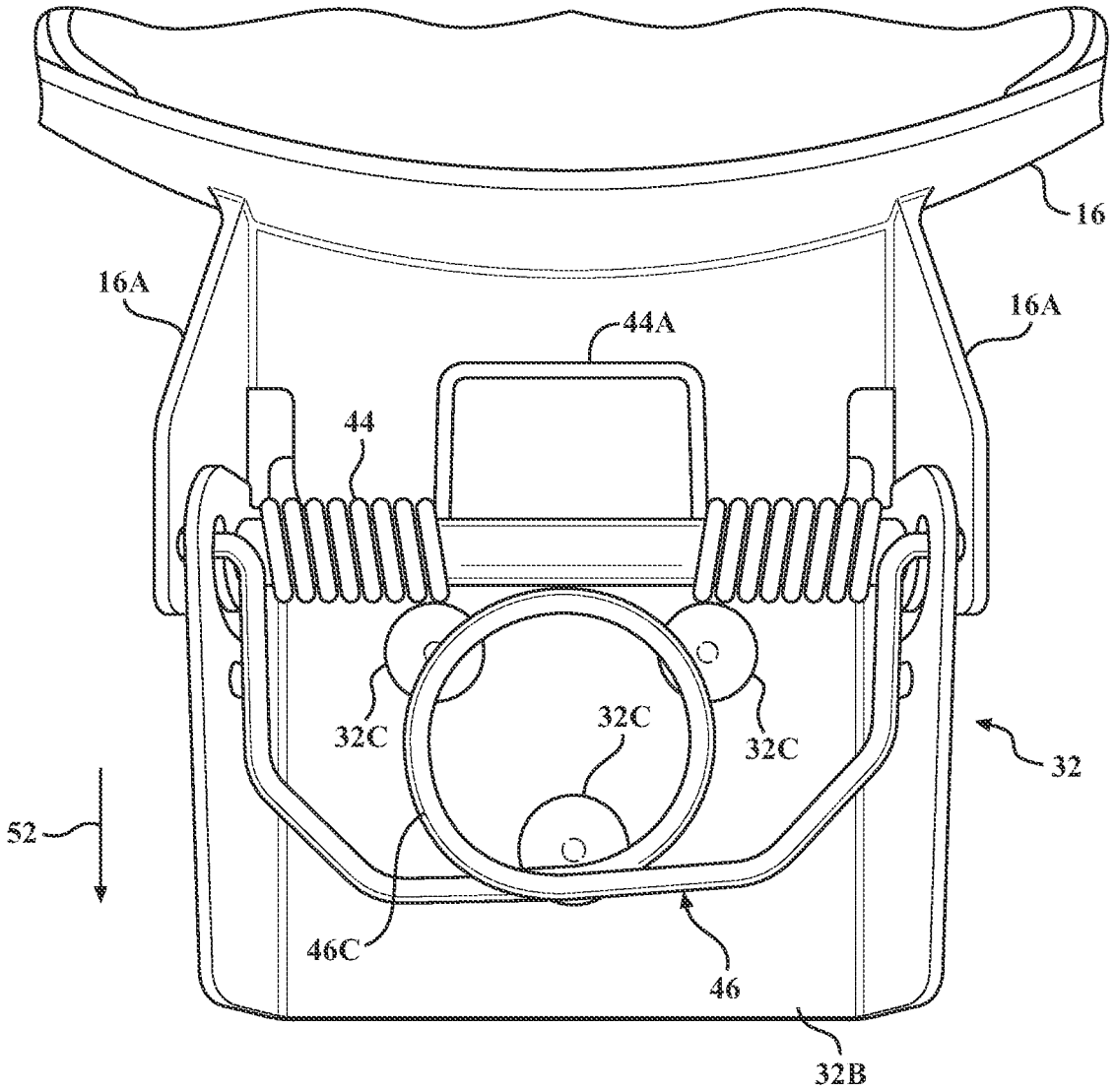
FIG. 7 is a close-up front view of the bracket shown in FIG. 5.

With reference to FIG. 7, a spring 44 biases the basketball rim 16 upwards about a pivot point 43 defined by the rod 42. In the illustrated embodiment, the rod 42 is located or positioned through a center of the spring 44. As shown, the spring 44 includes a first biasing portion 44A in contact with a surface of the basketball rim 16. In the illustrated embodiment, the first biasing portion 44A is centrally located on the spring 44. One or both of the ends (not shown) of the spring 44 are in contact with a surface of the U-shaped bracket 32B.

First and second ends of the clip 46 form pins 46A, 46B. Opposing sides of the U-shaped bracket 32B has a slot 48. Each slot 48 has a first arcuate portion 48A and a second arcuate portion 48B connected by an intermediate portion 48C.

Figure 8:
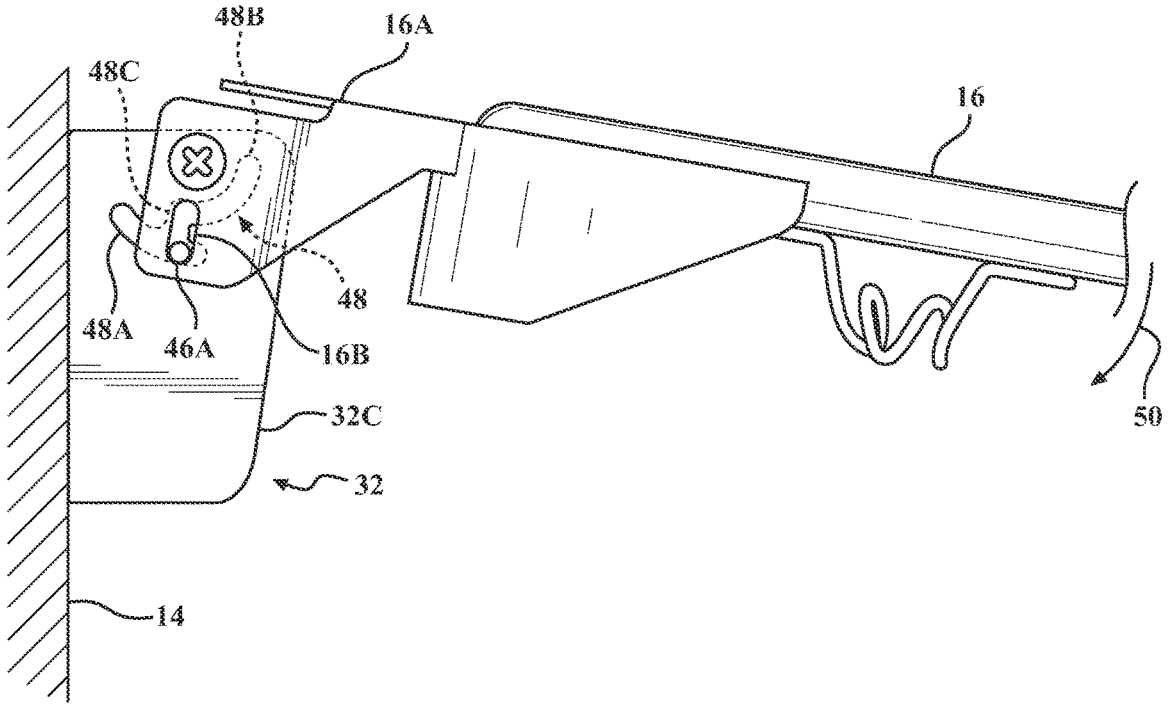
FIG. 8 is a first side view of the basketball rim of FIG. 6 as the basketball rim moves from a first position to in a second position.

As shown, the first and second pins 46A, 46B formed by the clip 46 are inserted into a respective slot 16B in one of the opposing side panels 16A of the basketball rim 16 and a respective slot 48 in one of the opposing sides of the U-shaped panel 32B. As shown in FIG. 8, when the basketball rim 16 is in the first position, i.e., the normal playing position, the first and second pins 46A of the clip 46 are located within a lower end of the slot 16B in the side panel 16A of the basketball rim 16.

Figure 3:
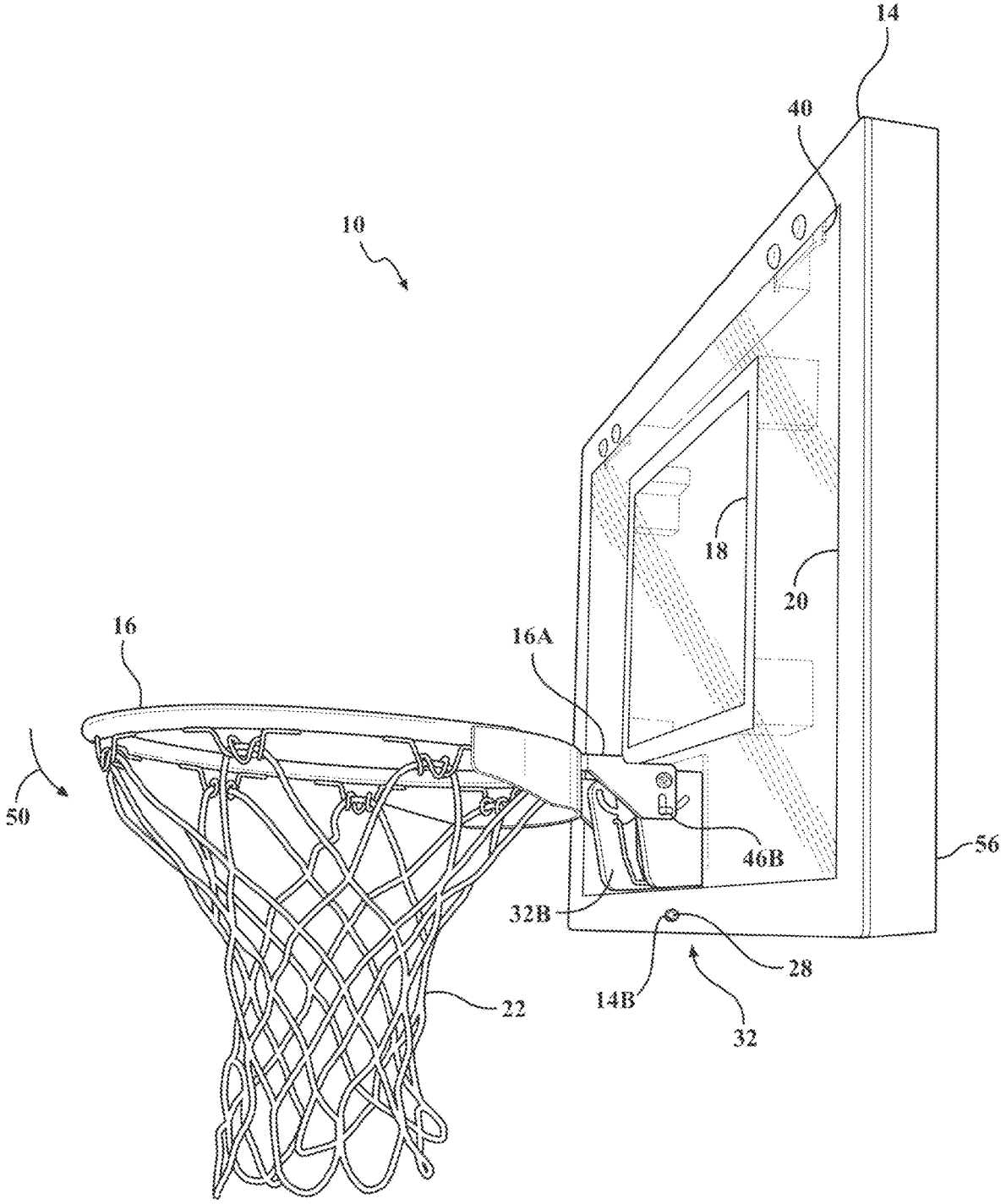
FIG. 3. is a second side view of the portable basket game of FIG. 1.
Figure 9:
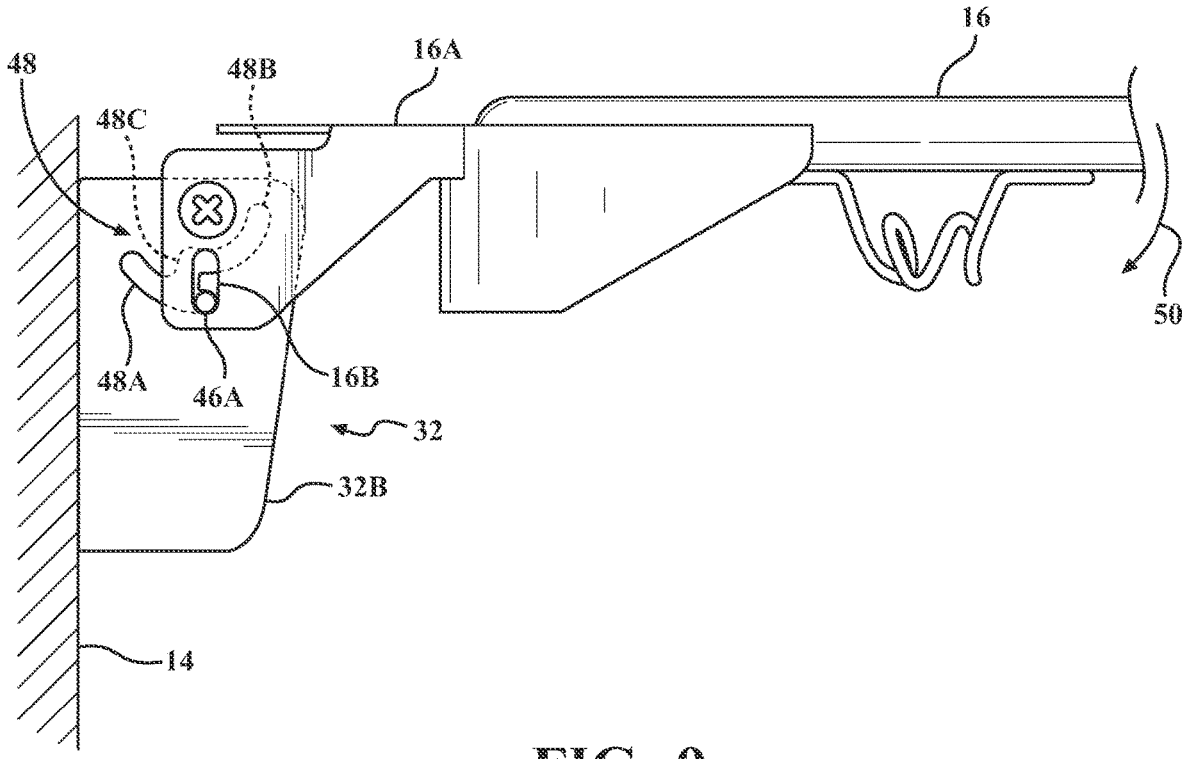
FIG. 9 is a second side view of the basketball rim of FIG. 6 in the first position.
Figure 10:
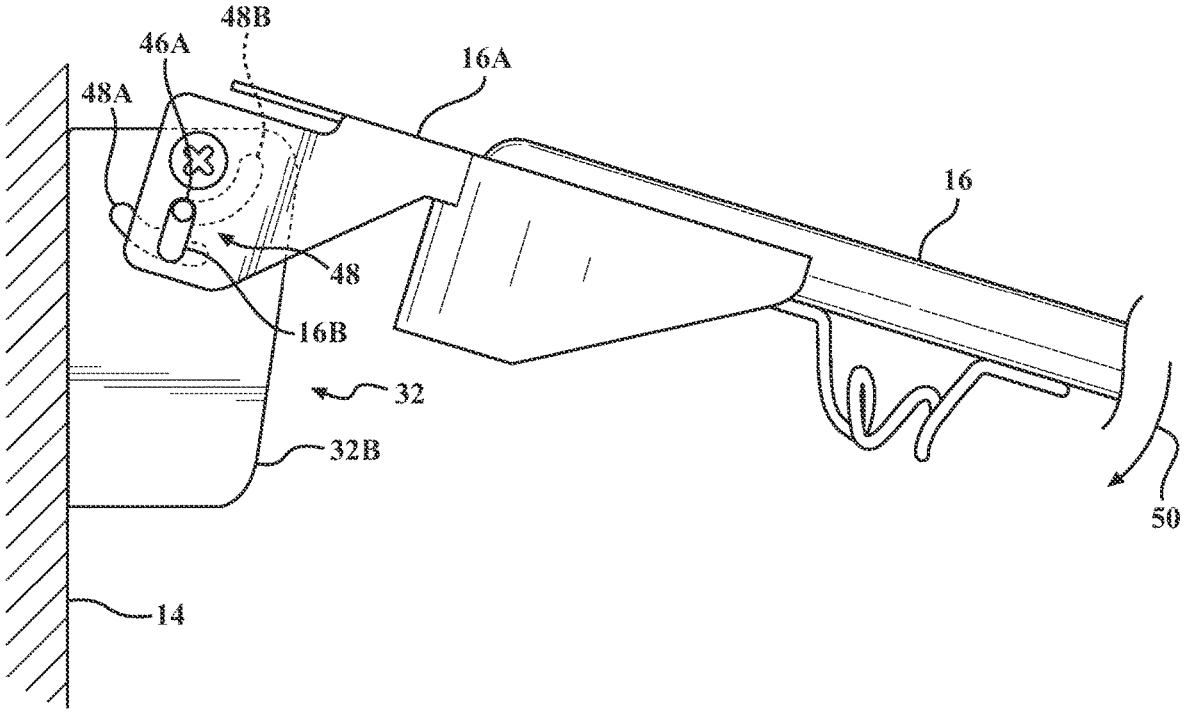
FIG. 10 is a third side view of the basketball rim of FIG. 6 in the second position.
Figure 12:
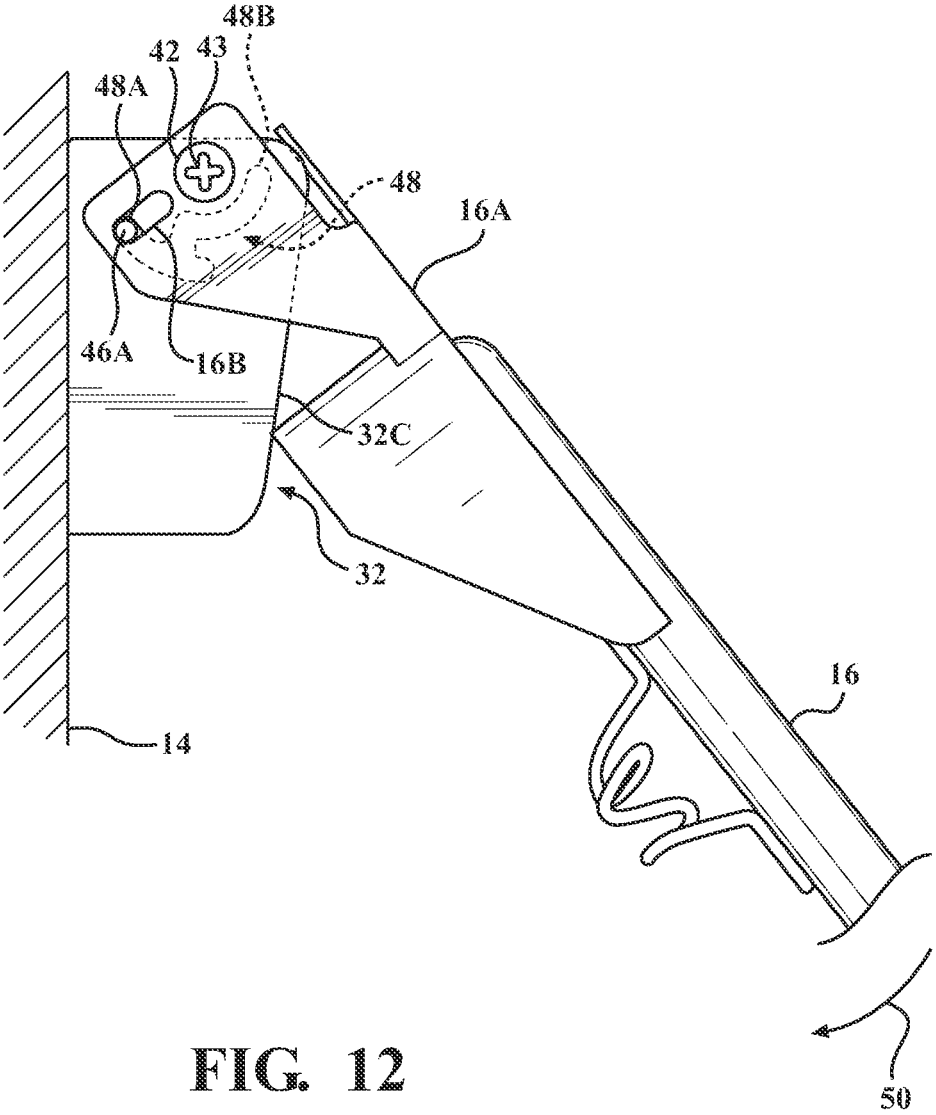
FIG. 12 is a perspective view of the portable basketball game of FIG. 1 when in a second position.
Figure 13:
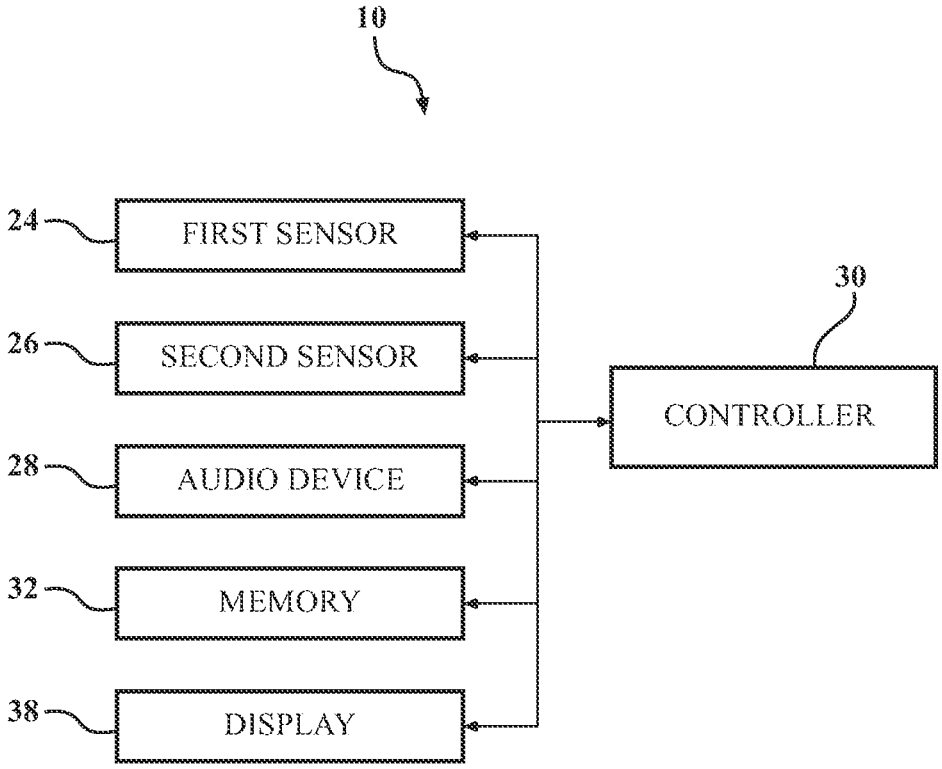
FIG. 13 is a block diagram of of the portable basketball game of FIG. 1.

As shown in FIGS. 3 and 9, while in the first position, the basketball rim 16 may be moved or flexed downward, i.e., from the first position to or towards the second position, about the pivot point 43 in the direction of arrow 50, for example, as a result of a dunk or attempted dunk. Motion of the pins 46A, 46B are constrained by or within the slots 16B, 48. As shown in FIG. 12, during a dunk or attempted dunk, the pins 46A, 46B slide within the first arcuate portion 48A of the slots 48 in the U-shaped bracket 32B. In the illustrated embodiment, the second position is defined by the opposite end of the first arcuate portion 48A (see FIG. 12).

Figure 11:
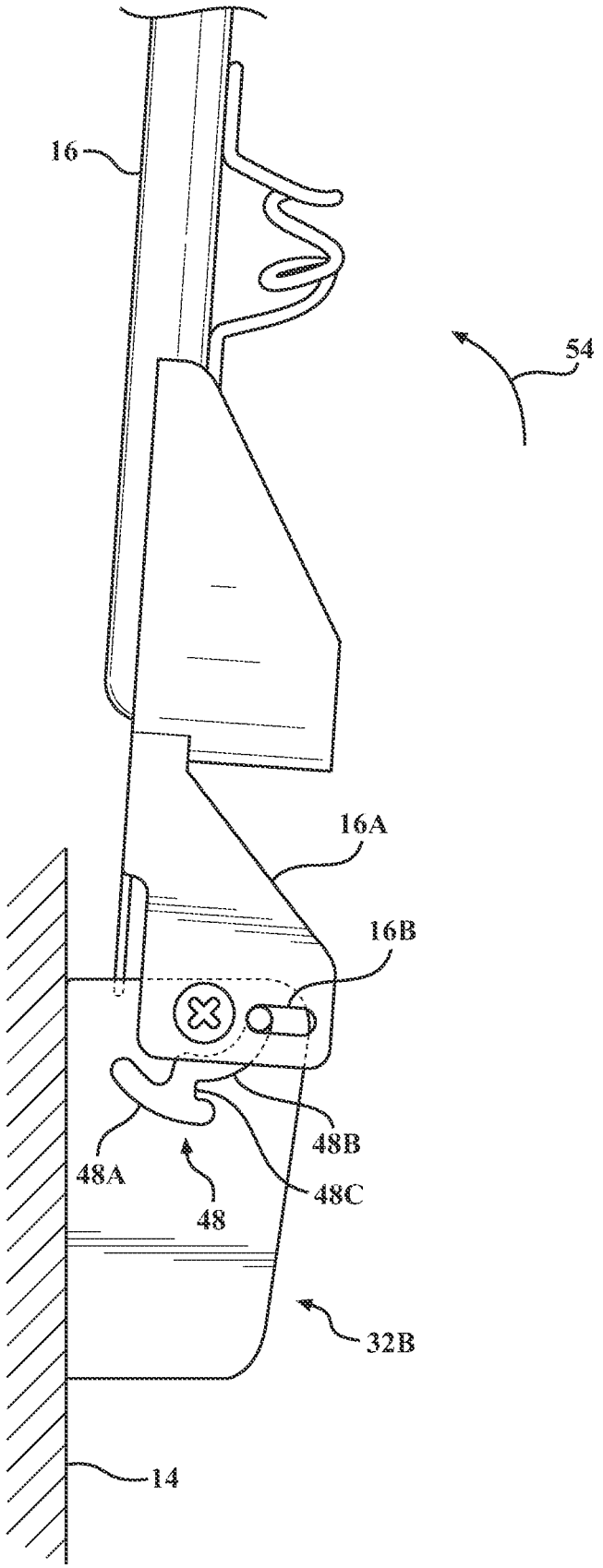
FIG. 11 is a fourth side view of the basketball rim of FIG. 7 in a third or storage position.

With reference to FIGS. 7-11, the clip 46 may be utilized to move the basketball rim 16 from the first position to the third (or storage) position (shown in FIG. 11). In the illustrated embodiment, the pins 46A, 46B are located within one end of the first arcuate portion 48A preventing upward movement of the basketball rim 16.

With reference to FIG. 7, the clip 46 may includes an engaging portion 46C. To release the basketball rim 16 the engaging portion 46C may be used to pull the clip 46 downward in the direction of arrow 52 while the basketball rim 16 is pulled downward in the direction of arrow 50. This results in the pins 46A, 46B moving along the first arcuate portion 48 of the slot 48 toward the intermediate portion 48C (shown FIG. 8). From there, the basketball rim 16 may be rotated upward in direction of arrow 54 (see FIG. 11). During this upward motion, the pins 46A, 46B move along the slots 16B in the opposing side panels 16A in the basketball rim 16 and then along the second arcuate portion 48B of the slots 48 in the U-shaped bracket (see FIGS. 10 and 11).

In one embodiment, the second sensor 26 is a displacement sensor that senses or detects movement of the basketball rim 16 from the first position to, or towards the second position. Such movement of the basketball rim 16 is indicative of a dunk shot being made. The second sensor 28 may be, for example, a sensor that detects a change in capacitance or magnetic field. In the illustrated embodiment, the first and second sensors 26, 28 are contained in the same package. As shown in FIGS. 2 and 3, the first sensor 24 is positioned with aperture 14B in the backboard 14 behind the basketball net 22.

Figure 4:
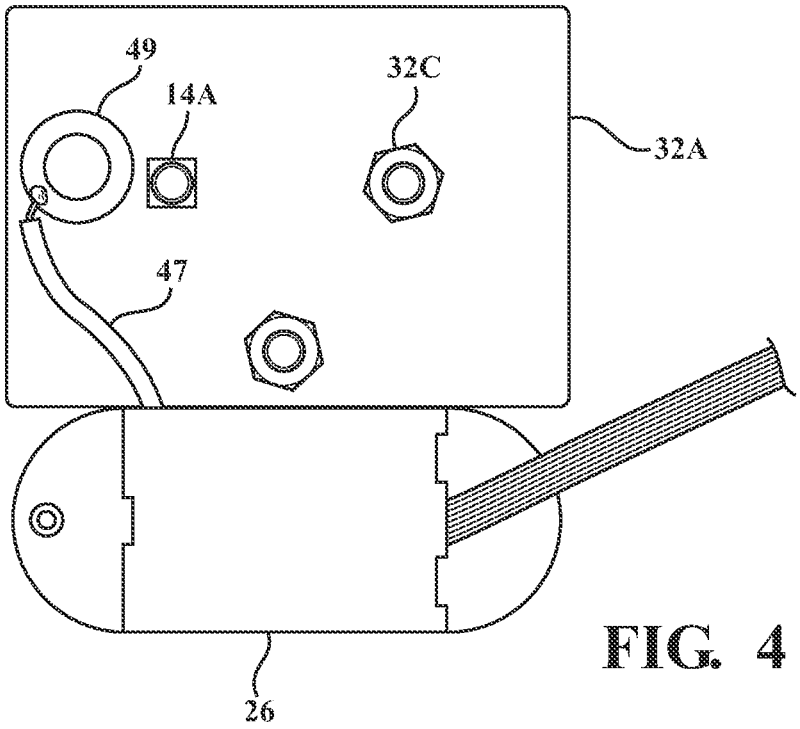
FIG. 4 is a first view of a dunk sensor and a bracket of the portable basketball game of FIG. 1.
Figure 5:
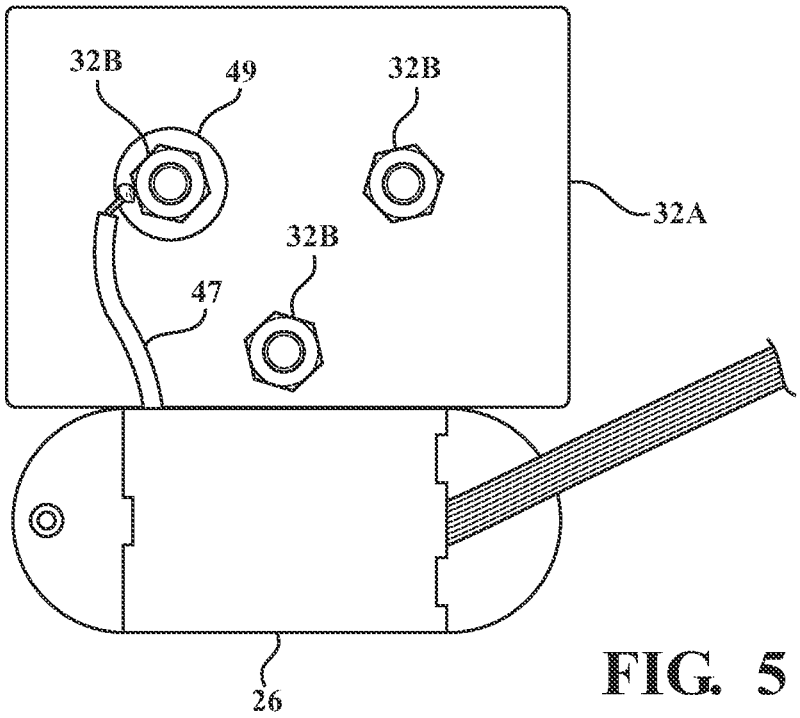
FIG. 5 is a second view of a dunk sensor and a bracket of the portable basketball game of FIG. 1.

With reference to FIGS. 4 and 5, in the illustrated embodiment, the second or dunk sensor 26 is electrically connected to one of the fasteners 32B. As shown, a wire 47 connects to the second sensor 26 to a washer 49 which is in contact with one of the fasteners 32B. As the basketball rim 16 is moved towards the second position, a change in capacitance or change in a magnetic field measured by the sensor 26 is detected by the controller 30 as an indication of a dunk or attempted dunk.

Figure 6:
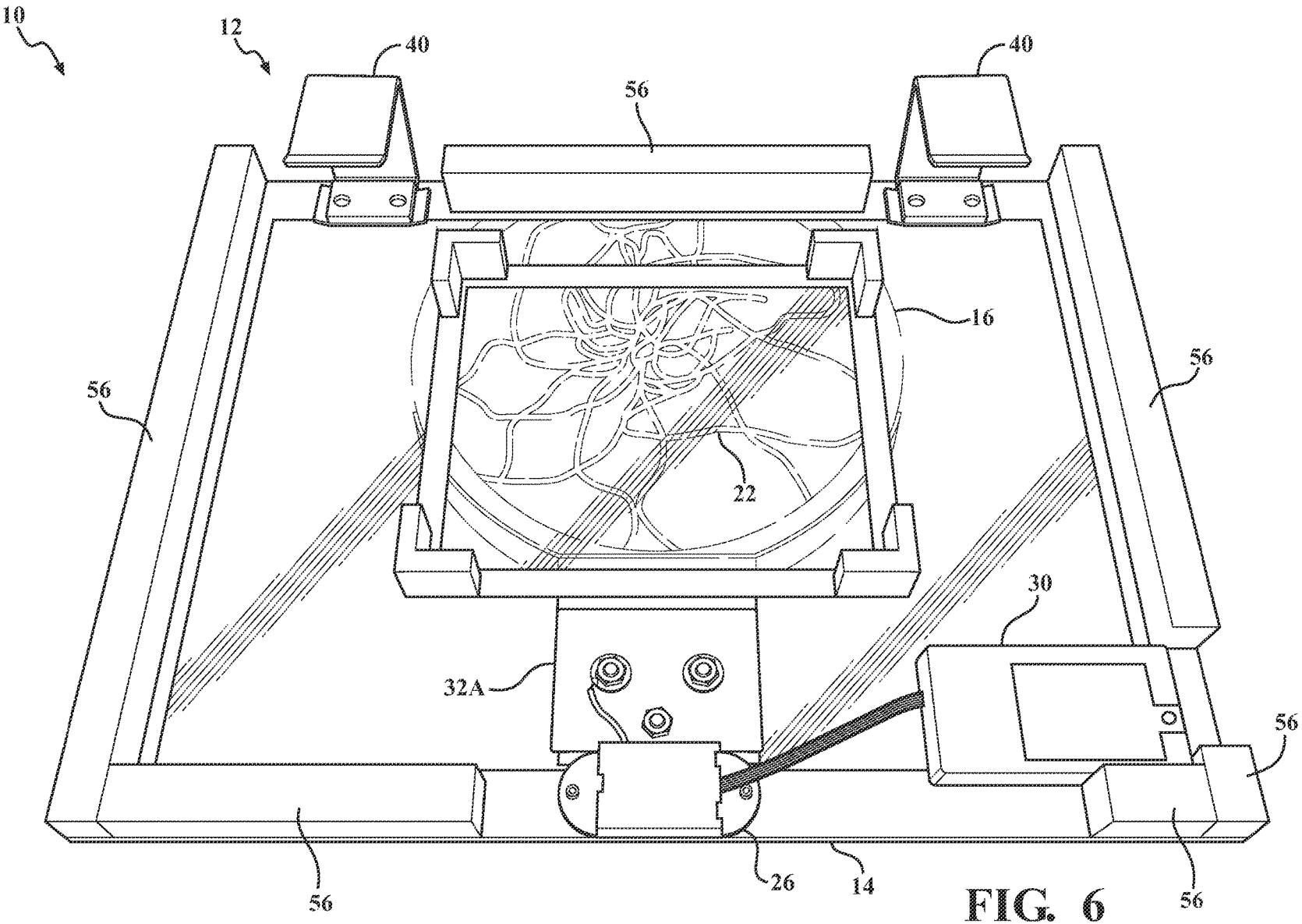
FIG. 6 is a rear view of the portable basketball game of FIG. 1 with a basketball rim in a fold-up position.
Figure 14:
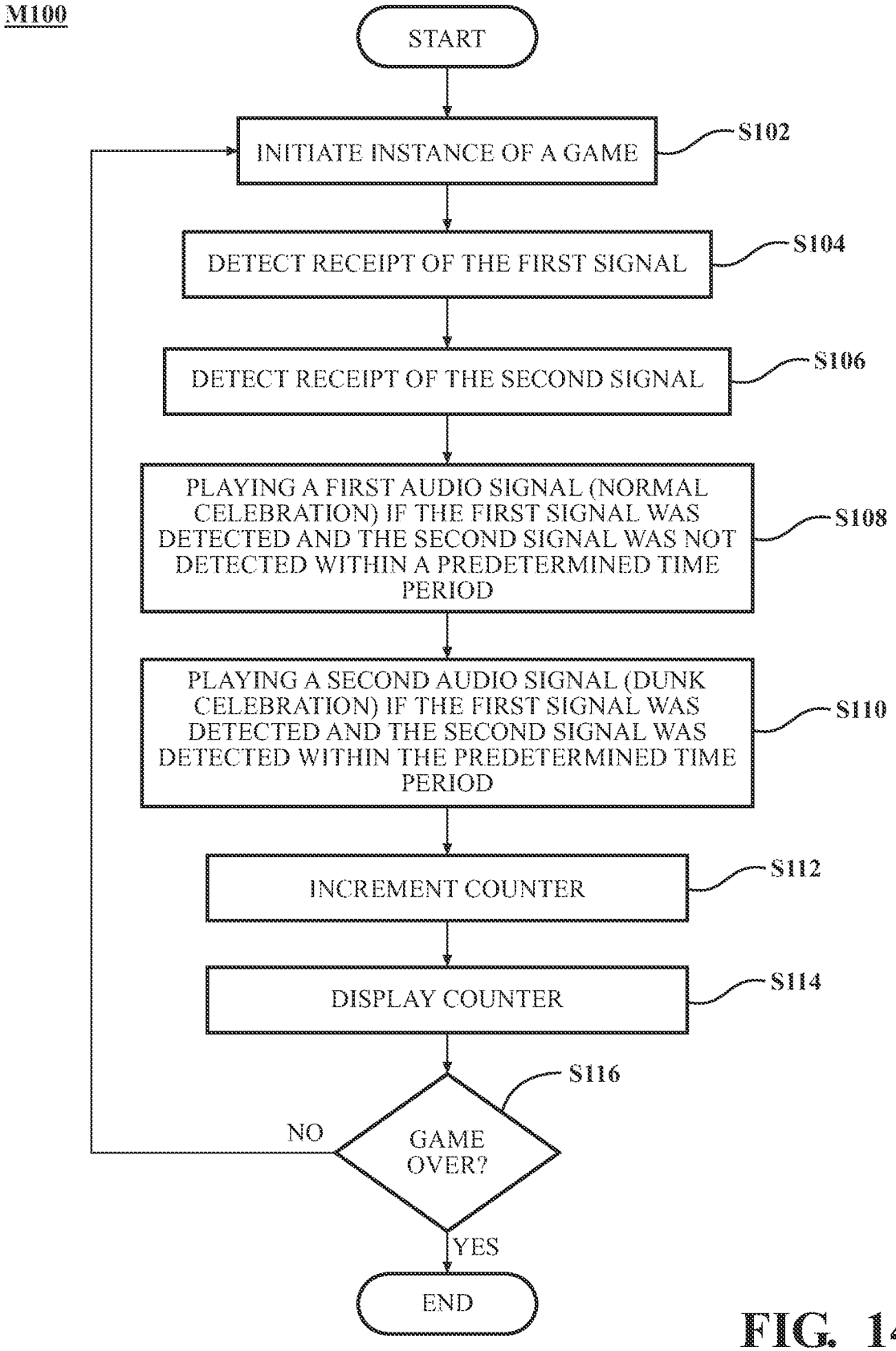
FIG. 14 is a flow diagram associated with the portable basketball game of FIG. 1, according to an embodiment of the present invention.

With specific reference to FIGS. 2, 6 and 14, in the illustrated embodiment, the controller 30 is mounted, or affixed, to a rear surface of the backboard 14. The first and second sensors 26, 28 are electrically connected to the controller 30. The controller 30 may a logic controller such as an application specific integrated circuit (ASIC) or programmable ASIC, or a microprocessor based controller. The controller 30 may include memory or a memory device 34. The controller 30, audio device 28 and memory 34 may be provided in a single package, as shown, and may include an on/off switch 36.

In one aspect of the present invention, the basketball game 10 plays a first audio signal or effect (or first celebration audio signal) when a normal basketball shot is made and a second audio signal or effect (or second celebration audio signal) when a dunk is made.

The first celebration effect may include, e.g., the sound of a cheering cloud and/or horns and/or buzzers and/or the like. The second celebration effect may include the sound of a the sound of a cheering cloud and/or horns and/or buzzers and/or the like and/or the sound of a fan yelling one or more congratulatory statements, for example: "Are you kidding me?", "Are you serious?", "Bang!", "Boom goes the dynamite", "Count it", "The crowd is going wild!", "The crowd likes that one", "Holy Cow!", "Kaboooooom!", "Posting and toasting", "What was that?!", "Whoa Nelly!", and "You can't teach that". In one embodiment of the present invention, an audio effect of a crowd cheering may be played when the controller 30 is turned on and/or at the initiation of a game. In addition, background music may be played during the entire game.

Audio files or data corresponding to the first and second audio signals may be stored in the memory device 34. The controller 30 may provide more than one option for each of the first and second audio signals. If more than one option is available, the controller 30 may cycle through the options in a predetermined pattern or order or may randomly select one of the available options.

The controller 30 is configured to receive the first and second signals indicative or representative of a shot (normal or dunk being made) and the basketball rim 16 moved from the first position towards the second position.

With specific reference to FIG. 14, a method M100 associated with the basketball game 10 and the controller 30 is shown. In a first step, S102, an instance of a game is initiated. As described in further detail below, the controller 30 establishes a counter and a timer for counting the number of baskets made during the instance of the game and for measuring elapsed time during the instance of the game. The timer and counter may be reset at the start of each instance of the game. In the illustrated embodiment, an instance of a game is played for a predetermined amount of time, for example, 30 seconds, as measured by the timer. It should be noted that the length of a game may be a different length of time or may be programmable or selectable from a number of predetermined time periods.

A game may be initiated when the on/off switch 36 is moved or switched to an an position. After an instance of the game has ended, a next game may be initiated by (1) turning the switch off and then on, (2) the first sensor 24 detecting a basketball going through the basketball rim 16 or net 22, and/or (3) an optional sensor (not shown) such as a touch sensor coupled to the controller 30 that initiates the next instance of the game.

In a second step S104, receipt of the first signal is detected. In a third step S106, receipt of the second signal is detected.

Generally, the controller 30 counts, using the counter, the number of points made during the instance of the game and displays the number of shots made or the number of points corresponding to shots made on a display 38 which may be a two digit LED display. In one embodiment, each shot made is worth two points. The basketball game 10 and/or the controller 30 may play an audio signal or celebratory sound after each basket. Further, the basketball game 10 and/or the controller 30 may distinguish between a normal shot and a dunk. If a normal shot is detected or established (and made), a first audio signal or celebratory sound is played. However, if a dunk is detected or established (and made), a second audio signal or celebratory sound is played.

In one aspect of the present invention, a normal shot is detected (as being made) if the first sensor 24, i.e., the IR sensor detects a basketball traveling through the basketball rim 16 and/or the net 22 and the second sensor 26 is not activated.

A dunk shot is detected (as being made) if the first sensor 24 is activated and the second sensor 26 is activated. In one embodiment, the second sensor 26 must be activated within a predetermined timer period, e.g., 100 milliseconds, of the activation of the first sensor 24 in order for a made dunk shot to be detected.

In one embodiment, it should also be noted that, the order of activation of the first and second sensors 24, 26 does not matter. In another embodiment, the second or dunk sensor 26 must be activated (and received) first, followed by activation of the first sensor 24 in order for a dunk to be registered.

Returning to FIG. 14 in a fourth step S108, if the first signal is detected and the second signal was not detected (within the predetermined time period) then the first audio signal (or normal celebration) is played. This is indicative of a basket being made which is not a dunk.

In a fifth step S110, if the first signal is detected and the second signal is detected (within the predetermined time period) then the second audio signal (or dunk celebration) is played. It should be noted, in the illustrated embodiment, for each shot made, only one of the first or second audio signals is played.

In a sixth step S112, a counter is incremented. In the illustrated embodiment, each shot made (dunk or non-dunk) is worth two points, so the counter is incremented by 2. In a sixth step S114, the counter is displayed on the display 38.

In a first decision block S116, if the game is over, i.e., the time period has (30 seconds) has expired), then the method M100 ends. If the game is not over, then the method M100 proceeds back to the first step S102.

As discussed above, in one embodiment of the present invention, the controller 30 is a logic controller. An exemplary logic diagram L100 is shown in FIG. 15.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A portable basketball game, comprising:

a mounting bracket;

a backboard mounted to the mounting bracket;

a basketball rim rotatably coupled to the backboard and being movable between a first position and a second position;

a first sensor configured to detect a basketball traveling though the basketball rim and to responsively generate a first signal;

a second sensor configured to detect movement of the basketball rim from the first position to the second position and to responsively generate a second signal;

an audio device; and, a controller mounted to the backboard, the first and second sensors and the audio device being electrically coupled to the controller, the controller configured to receive the first and second signals, the controller performing the steps of:

initiating an instance of a game;

detecting receipt of the first signal;

detecting receipt of the second signal;

playing a first audio signal through the audio device if the first signal was detected and the second signal was not detected within a predetermined time period; and playing a second audio signal through the audio device if the first signal was detected and the second signal was detected within a predetermined time period.

2. A portable basketball game, as set forth in claim 1, wherein the controller maintains a counter indicative of a number of points made during the game.

3. The portable basketball game, as set forth in claim 2, wherein the controller resets the counter when the game is initiated.

4. The portable basketball game, as set forth in claim 3, wherein the controller increments the counter in response to receipt of the first signal.

5. The portable basketball game, as set forth in claim 4, further comprising a display coupled to the controller, the controller configured to display the counter on the display.

6. The portable basketball game, as set forth in claim 1, wherein the mounting bracket includes a pair of hooks configured to mount over a door.

7. The portable basketball game, as set forth in claim 1, including a basketball rim mounting bracket connected to the basketball backboard, the basketball rim being rotatably coupled to the basketball rim mounting bracket.

8. The portable basketball game, as set forth in claim 7, wherein the second sensor is a displacement sensor coupled to the basketball rim mounting bracket, the second sensor detects movement of the basketball rim away from the basketball rim mounting bracket.

9. The portable basketball game, as set forth in claim 1, wherein the controller includes an on/off switch, the controller initiating the instance of the game when the switch is moved from an off position to the on position.

10. The portable basketball game, as set forth in claim 9, wherein the instance of the game has a predetermined time period.

11. The portable basketball game, as set forth in claim 10, wherein the predetermined time period is 30 seconds.

12. The portable basketball game, as set forth in claim 10, wherein the controller counts a number of baskets made during the predetermined time period.

13. A portable basketball game, comprising:

a mounting bracket;

a backboard mounted to the mounting bracket;

a basketball rim rotatably coupled to the backboard and being movable between a first position and a second position;

a first sensor configured to detect a basketball traveling though the basketball rim and to responsively generate a first signal;

a second sensor configured to detect movement of the basketball rim from the first position to the second position and to responsively generate a second signal;

a display device;

an audio device; and, a controller mounted to the backboard, the first and second sensors, the display, and the audio device being electrically coupled to the controller, the controller configured to receive the first and second signals, the controller performing the steps of:

initiating an instance of a game;

detecting receipt of the first signal;

detecting receipt of the second signal;

playing a first audio signal through the audio device if the first signal was detected and the second signal was not detected within a predetermined time period;

playing a second audio signal through the audio device if the first signal was detected and the second signal was detected within a predetermined time period; and, maintaining a counter indicative of a number of points made during the game; and displaying the counter on the display.

14. The portable basketball game, as set forth in claim 13, wherein the second sensor is a displacement sensor coupled to the basketball rim mounting bracket, the second sensor detects movement of the basketball rim away from the basketball rim mounting bracket.

15. The portable basketball game, as set forth in claim 13, wherein the controller includes an on/off switch, the controller initiating the instance of the game when the switch is moved from an off position to the on position.

16. The portable basketball game, as set forth in claim 13, wherein the instance of the game has a predetermined time period.

17. The portable basketball game, as set forth in claim 16, wherein the predetermined time period is 30 seconds.

18. The portable basketball game, as set forth in claim 16, wherein the controller counts a number of baskets made during the predetermined time period.

19. A portable basketball game, comprising:

a mounting bracket including a pair of hooks configured to mount over a door;

a backboard mounted to the mounting bracket;

a basketball rim mounting bracket connected to the basketball backboard;

a basketball rim rotatably coupled to the basketball rim mounting bracket and being movable between a first position and a second position;

a first sensor configured to detect a basketball traveling though the basketball rim and to responsively generate a first signal;

a second sensor configured to detect movement of the basketball rim from the first position to the second position and responsively to responsively generate a second signal;

a display device;

an audio device; and, a controller mounted to the backboard, the first and second sensors, the display, and the audio device being electrically coupled to the controller, the controller including an on/off switch, the controller configured to receive the first and second signals, the controller performing the steps of:

initiating an instance of a game in response to the switch being moved from an off position to an on position, the instance of the game;

detecting receipt of the first signal;

detecting receipt of the second signal;

playing a first audio signal through the audio device if the first signal was detected and the second signal was not detected within a predetermined time period;

playing a second audio signal through the audio device if the first signal was detected and the second signal was detected within a predetermined time period;

maintaining a counter indicative of a number of points made in the game during the predetermined time period; and displaying the counter on the display.

* * * * *